United States Patent [19]

Long et al.

[11] 4,006,519

[45] Feb. 8, 1977

[54] APPARATUS FOR MAKING TAP CONNECTIONS TO MULTI-CONDUCTOR CABLE

[75] Inventors: Robert Alvin Long; William Boderick Over, both of Harrisburg, Pa.

[73] Assignee: AMP Incorporated, Harrisburg, Pa.

[22] Filed: Nov. 19, 1975

[21] Appl. No.: 633,192

[52] U.S. Cl. ..... 29/749; 29/75 G; 29/628

[51] Int. Cl.[2] ..... HOIR 43/04

[58] Field of Search ... 29/203 MW, 203 H, 203 HT, 29/203 HC, 203 P, 628

[56] References Cited

UNITED STATES PATENTS 3,766,622 10/1973 Brehm et al. ..... 29/203 MW

*Primary Examiner*—Carl E. Hall

*Attorney, Agent, or Firm*—Frederick W. Raring; Robert W. Pitts; Jay L. Seitchik

[57] ABSTRACT

Machine for inserting intermediate portions of wires into a wire-receiving portions of terminals in a two-row multi-contact electrical connector comprises a frame having a connector supporting member extending cantilever fashion from the frame. Wire insertion stations are located on each side of the connector supporting means and have insertion rams for moving the wires laterally of their axes and into the wire-receiving portions of the terminals. The cantilever arrangement of the connector supporting means provides clearance for the wires after they have been inserted into the terminals so that the connector supporting means can be indexed towards the frame so as to position all of the terminals in alignment with inserting rams. A wire stop means is provided at the wire insertion stations which serves to position the wires being inserted in alignment with the inserting rams and to permit movement of the inserted wires past the insertion station during indexing.

11 Claims, 11 Drawing Figures

APPARATUS FOR MAKING TAP CONNECTIONS TO MULTI-CONDUCTOR CABLE

BACKGROUND OF THE INVENTION

This invention relates to an apparatus of the general type shown in U.S. Pat. No. 3,766,622 for inserting wires into the wire receiving portions of electrical terminals which are contained in a two row electrical connector.

U.S. Pat No. 3,760,335 discloses and claims a preloaded electrical connector which contains contact terminals arranged in two parallel rows. The contact terminals have wire-receiving portions which are adapted to receive wires upon movement of the wires laterally of their axes and into the wire-receiving portions, an electrical and mechanical connection of each wire to its contact being achieved upon such movement of the wires. Usually, the wire inserting operation is carried out with a suitable tool or machine such as the tool shown in U.S. Pat. No. 3,758,935 which inserts all of the wires in a single operation or a machine of the type shown in U.S. Pat. No. 3,766,622 which inserts two wires during each operating cycle. The apparatus of the later type produces higher production rather than the tool shown in U.S. Pat No. 3,758,935 because of certain wire handling conditions and the machine is therefore preferred under many circumstances.

Both types of apparatus discussed above conventionally trim the wires at the time of insertion into the wire receiving portions of the terminals so that the connector is provided on the ends of the wires or on the end of the multi-conductor cable which contains all of the wires extending to the conductor. There are many circumstances, however, where it is desirable to have the connector connected to the wires intermediate the ends of the wires as where a tap connection is being made to a multi-conductor cable. U.S. Pat. No. 3,803,695 discloses the connection of intermediate portions of wires in a cable to an electrical connector and discloses a manually operated mass insertion tool for making electrical connections of this type. As noted above, however, the power driven machine of the type shown in U.S. Pat. No. 3,766,622 is preferred under many circumstances where wires are being connected to connector and it has become apparent that there is a need for a powered apparatus of this type which will be capable of attaching intermediate portions of wires to connectors. Inspection of U.S. Pat. No. 3,766,622 will reveal, however, that this type of machine does not lend itself directly to the connection of intermediate portions tap wires to the connectors.

It is an object of the instant invention to provide an improved wire inserting apparatus for inserting wires into the wire receiving portions of terminals in an electrical terminal. A further object is to provide an apparatus for inserting intermediate portions of wires into the terminals of an electrical connector. A further object is to provide a versatile form of wire inserting apparatus which can be used for inserting intermediate parts of wires or end portions of wires into the ends of terminals of an electrical connector. A further object is to provide an improved apparatus for making tap connections to a multi-conductor cable without the necessity of cutting the wires in the cable.

These and other objects of the invention are achieved in preferred embodiments thereof which are briefly described in the foregoing abstract, which are described in detail below, and which are shown in the accompanying drawing in which.

Figure 4A:
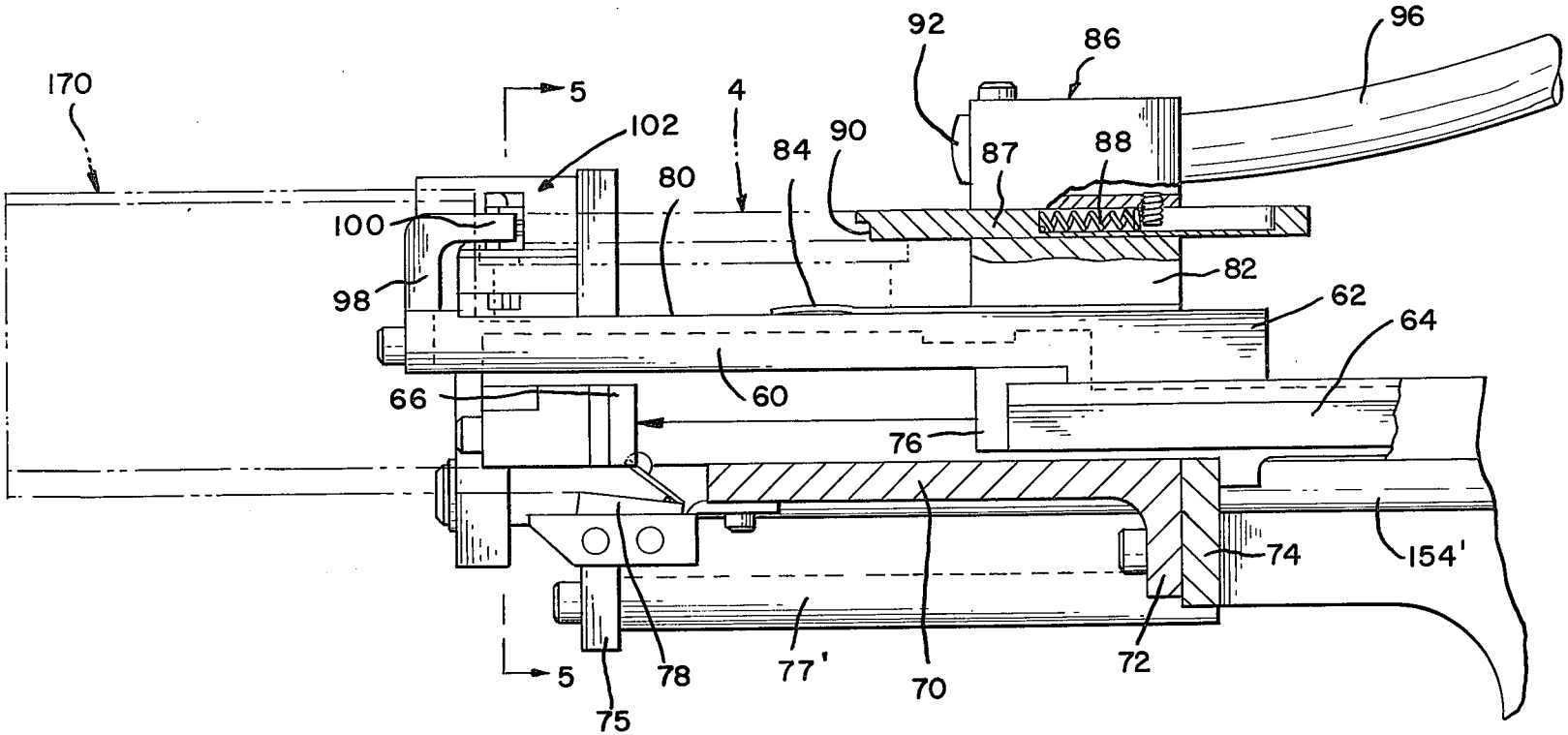
Figure 4B:
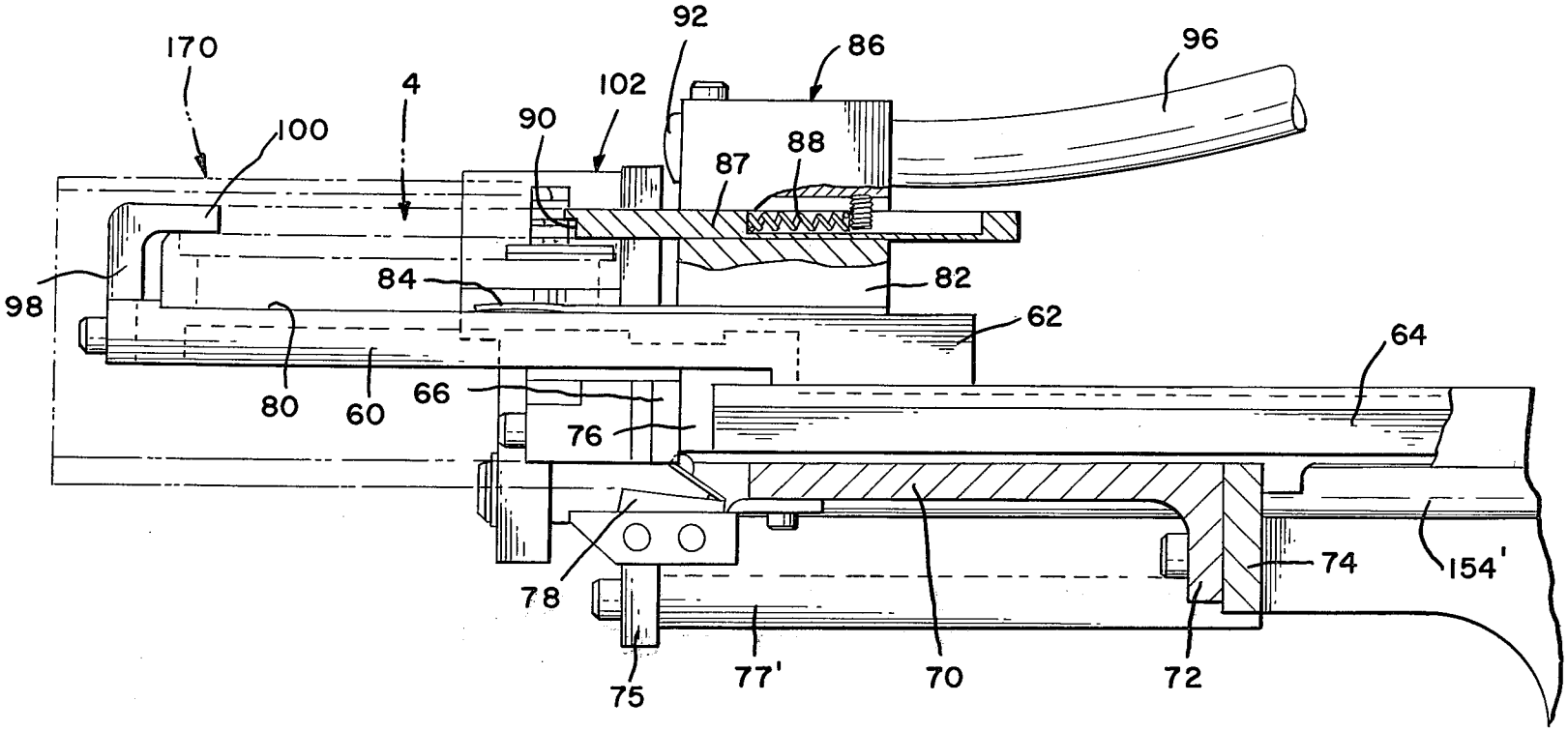
FIG. 4B is a view similar to FIG. 4A showing the positions of the parts when the connector supporting means or carriage is in its extended position.
Figure 9:
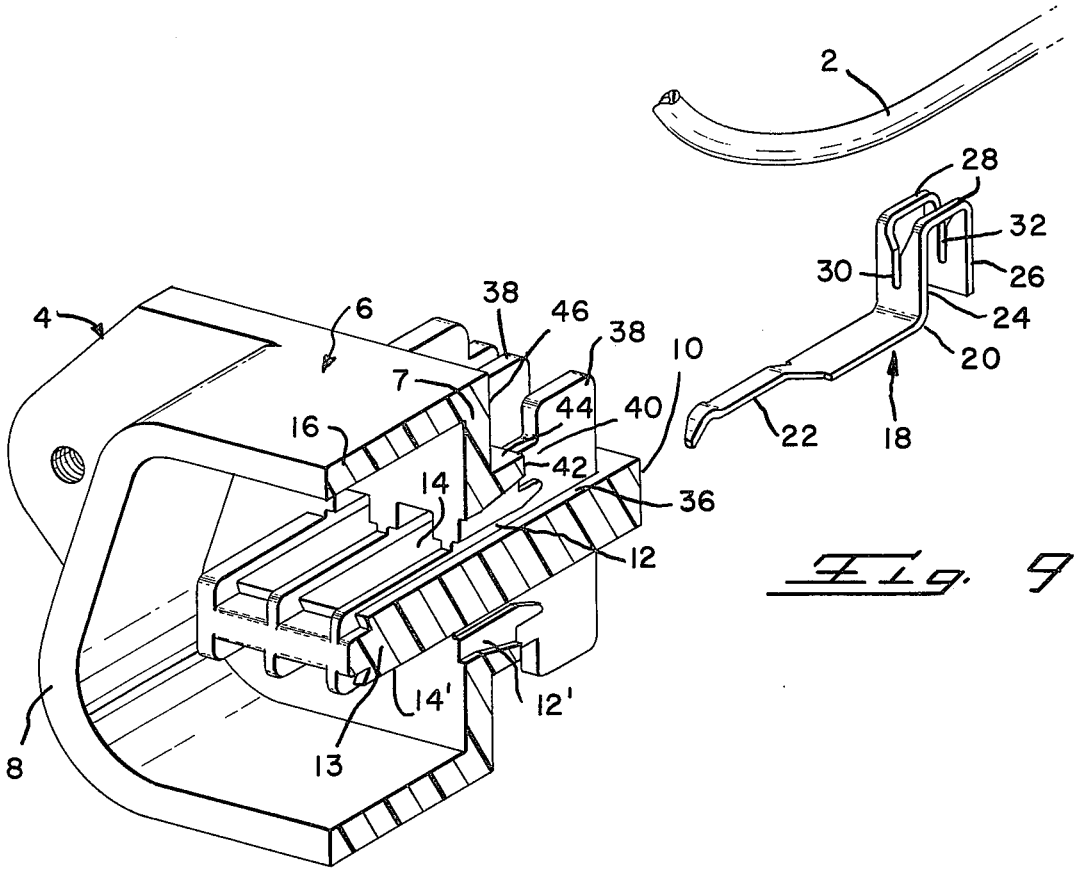
FIG. 9 is a fragmentary sectional view of a multi-contact electrical connector of the type for which the disclosed embodiment is intended.
Figure 10:
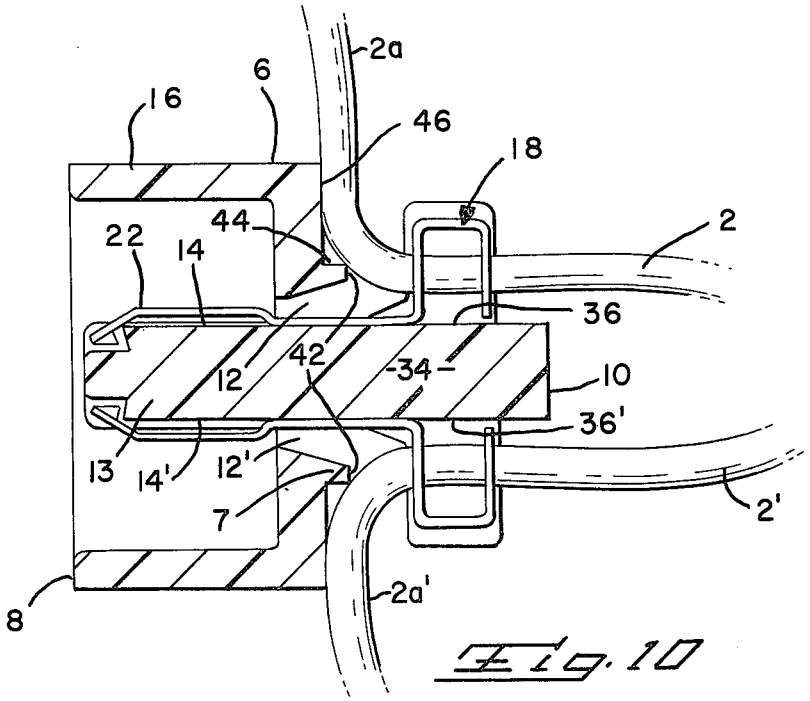
FIG. 10 is a cross section which view of the connector of FIG. 9 with intermediate portions of wires connected to the terminals.

The disclosed form of apparatus 50 in accordance with the invention is adapted to connect intermediate portions of conductors 2, 2' to contact terminals mounted in an electrical connector 4 (FIGS. 9 and 10). After the conductors have been connected to the terminals, they extend towards the rearward side of the connector, are connected to terminals 18 in the connector, and extend from these terminals as indicated at *2a* and *2a'*. The connector 4 has two parallel rows of terminals as will be explained below and the conductors 2 extend to the terminals in the upper row while the conductors 2' extend to the conductors in the lower row.

central body portion 7, a mating side 8, and a rearward side 10. Contact receiving cavities 12 extend leftwardly from the rearward side to the mating side and open onto the surfaces 14, 14' of a rib 13 which projects centrally from the body portion. As will be apparent from FIG. 4, the connector is symmetrical about its horizontal center line and the same reference numerals, differentiated by prime marks, are used for the corresponding structural elements on the upper and lower sides of this center line. In the interest of brevity, only the upper portion of the connector is described in detail.

A hood 16 projects forwardly from body portion 7 in surrounding relationship to the rib 13, this hood being adapted to surround a complementary connector part when mated therewith as fully described in U.S. Pat. No. 3,760,335.

The individual contact terminals 18 which are contained in the cavities 12 have a central shank portion 20, a contact arm of reduced width 22 which extends from the shank, and a pair of spaced apart plate sections 24, 26 on the rearward end of the shank. The plate sections are joined to each other at their upper ends by parallel straps 28 between which a conductor is moved into slots 30, 32 in the plate sections when the conductor is to be electrically connected to the terminal.

A rib 34 projects from the rearward side of the housing and has a surface 36 on which the shank portions 20 of the terminals are supported. Vertically extending barrier plates 38 extend upwardly from the surface 36 and function to isolate the individual terminals each from the other. At their righthand ends, as viewed in FIG. 4, the dimensions of these barrier plates are such that their edges are beyond the plate sections 24, 25 and straps 28. The barriers are of reduced height adjacent to the body portion of the housing as shown at 40 and merge with a rearwardly facing surface 42 which extends normally of the surface 36. Surface 42 merges with a ledge 44 which is parallel to surface 36 and this ledge in turn merges with another rearwardly facing surface 46 of the intermediate body portion 7 of the housing.

As shown in FIG. 10, the conductors 2, 2' extend towards the rib 34 and diverge adjacent to this rib, the conductors 2 extending upwardly as viewed in FIG. 10 through the aligned slots of the plate sections of the terminals in the upper row thence to the surfaces 42, 46 and upwardly while the conductors 2' are similarly arranged with respect to the terminals in the lower row.

Referring now to FIGS. 1–4B, the apparatus 50 comprises a frame means, which will be described in part below, having side cover plates 52, a top cover plate 54, a front cover plate 56, and an externally mounted electric drive motor 58. The actuating mechanisms contained in the housing are substantially similar to those fully described in U.S. Pat. No. 3,766,622 which is hereby incorporated by reference in its entirity. A description of the novel structure of the apparatus 50 which permits the connection of intermediate portions of wires to the terminals in the connector is presented below.

Figure 1:
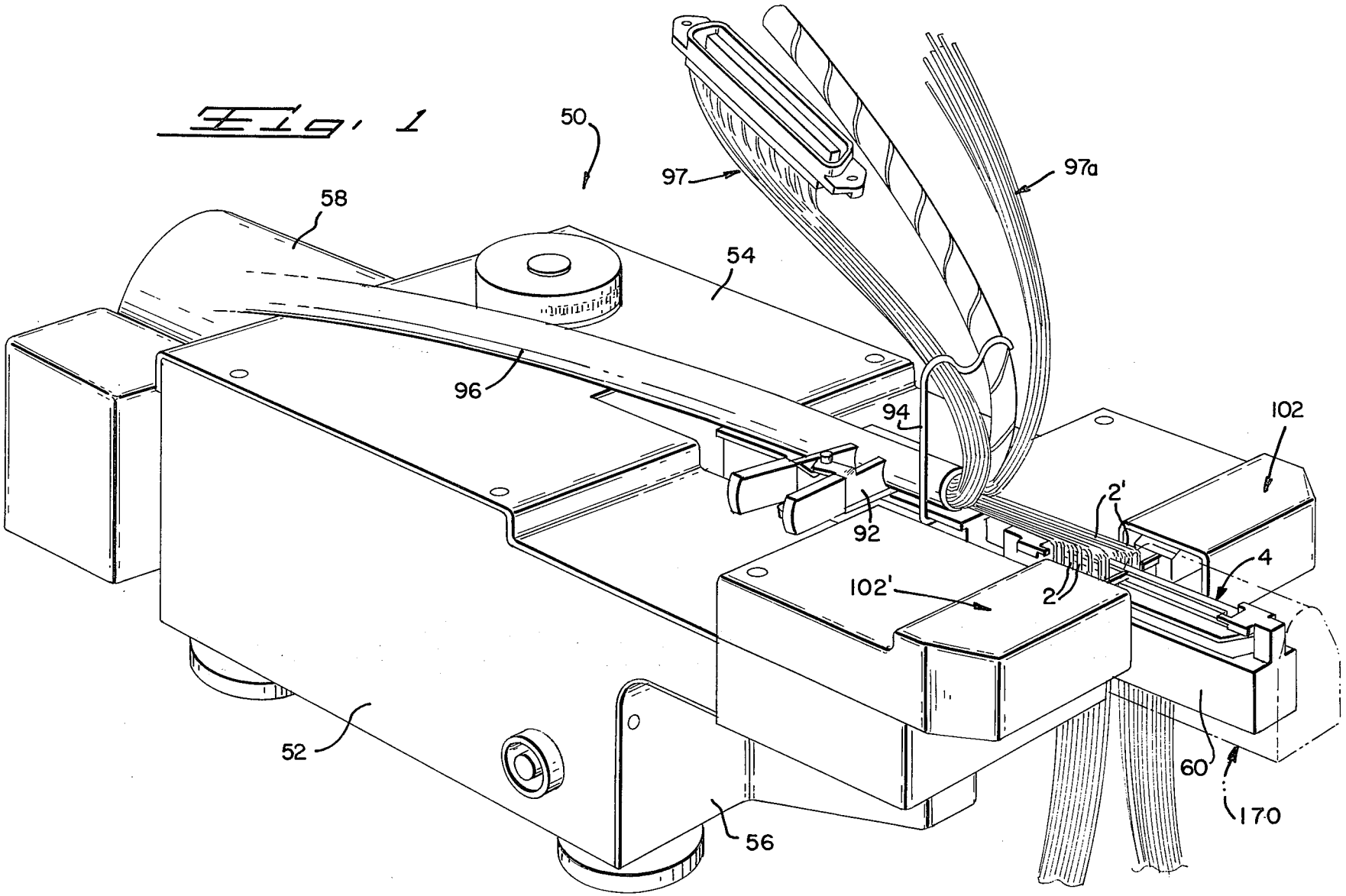
FIG. 1 is a perspective view of a preferred form of apparatus in accordance with the invention, this view showing the connector supporting means in a position which is between its extended position and its retracted position.

A bar-like connector supporting member 60 (FIG. 4A) extends, cantilever fashion, from the front end of the apparatus and the righthand end 62 of this support member is secured to the upper surface of a carriage 64. The carriage extends into the interior of the machine and means are provided for indexing this carriage from the extended position of FIG. 4B to the retracted position of FIG. 4A so that the connector supporting member will move past wire insertion stations 102, 102'. FIG. 1 shows the carriage and connector support 60 in a position which is between its extended position and its retracted position. The indexing mechanism is described fully in the above-identified U.S. Pat. No. 3,766,622, the distance which the carriage is indexed during each operating cycle being equal to the spacing between adjacent terminals 18 in the connector so that each pair of aligned terminals 18, 18' will be presented at the wire insertion station during operation. The leftward movement (in FIG. 4B) of the carriage and the connector support member 60 is limited by a fixed stop block 66 and when the carriage is moved to its extended position, (FIG. 4B) the arm of a switch 78 is moved downwardly so that the condition of the switch is changed. This switch forms part of the circuitry which controls the operation of the apparatus.

Figure 3:
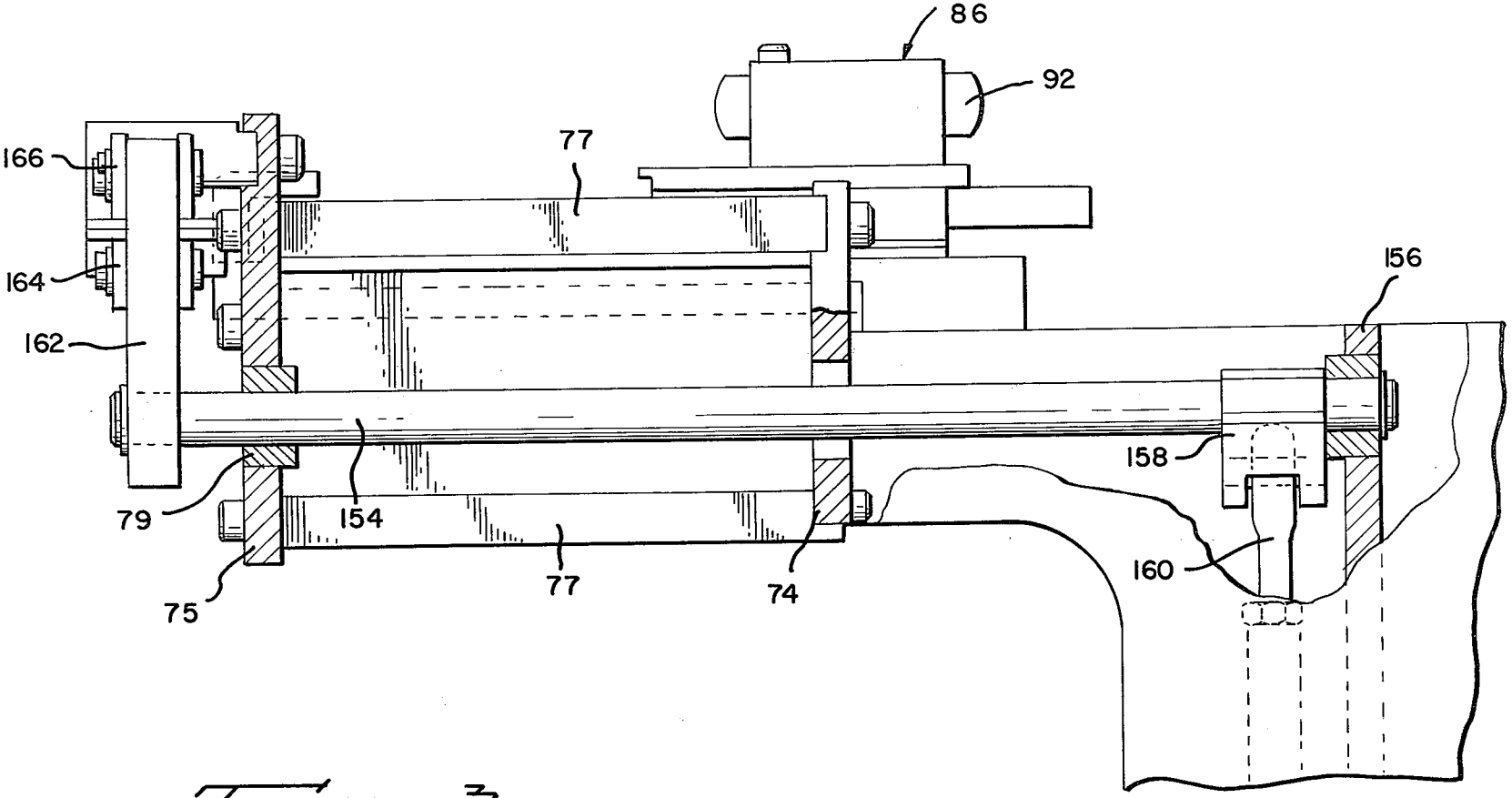
FIGS. 3 and 4A are views taken along the lines 3—3 and 4—4 of FIG. 2, these views showing the connector supporting means or carriage in its retracted position.

The carriage is supported by spaced apart side rails 68, 68' which extend from the frame front wall 74. Additional support is provided by the horizontally extending arm 70 of an L-shaped bracket which has an end portion 72 secured by suitable fasteners to end wall 74. As shown in FIG. 3, static supporting means for the wire insertion stations 102, 102' and for the actuating means at these stations is provided in the form of horizontally extending support members 77 which are secured to, and extend from, end wall 74. A vertically extending support plate 75 is fixed to the ends of these support members and provides a bearing support 79 for an oscillatable shaft 154 described below and for the frame plates of the insertion stations.

The upper surface 80 of the connector support 60 constitutes a connector supporting surface and a spacer block 82 is fixed to this surface at the righthand end of the connector support. Advantageously, a thin leaf spring 84 is clamped beneath the block 82 and extends leftwardly in FIG. 4 so that its end is beneath the connector on the surface 80. The connector thus is resiliently biased against the clamping surfaces 90, 100 described below and will be firmly held during operation of the machine.

An L-shaped connector locating block 86 is disposed on the upper surface of the spacer block 82 and has a base 87 which has a resilient lost motion connection to the block 82 as shown at 88. This resilient lost motion connection biases the block 87 leftwardly as viewed in FIG. 4A while permitting rightward movement of the block against the biasing force of the spring. By virtue of this arrangement, the connector is clamped between the notched end 90 of the base 87 of block 86 and the laterally extending arm 100 of a locating bracket 98 which is secured to the end of the supporting member 60.

The apparatus 50 is frequently used to connect the wires in a multi-conductor cable having a sheath 96 to the terminals in electrical connectors 4. Advantageously, a cable clamp 92 is mounted on the block 86 to secure the cable in a fixed position while the operator performs the wire inserting operations. In FIG. 1, the cable is shown as having a plurality of bundles 97 of wires, each bundle having a number of wires equal to the number of terminals in a single connector 4 so that after termination of the cable, it will have several connectors 4 on its end. It is desirable to provide a bracket 94 on the block 86 to facilitate dressing of the bundles away from the insertion stations 102, 102' a single bundle of wires 97*a* being free while they are being handled by the operator and connected to the terminals in the connector as shown in FIG. 1.

Figure 2:
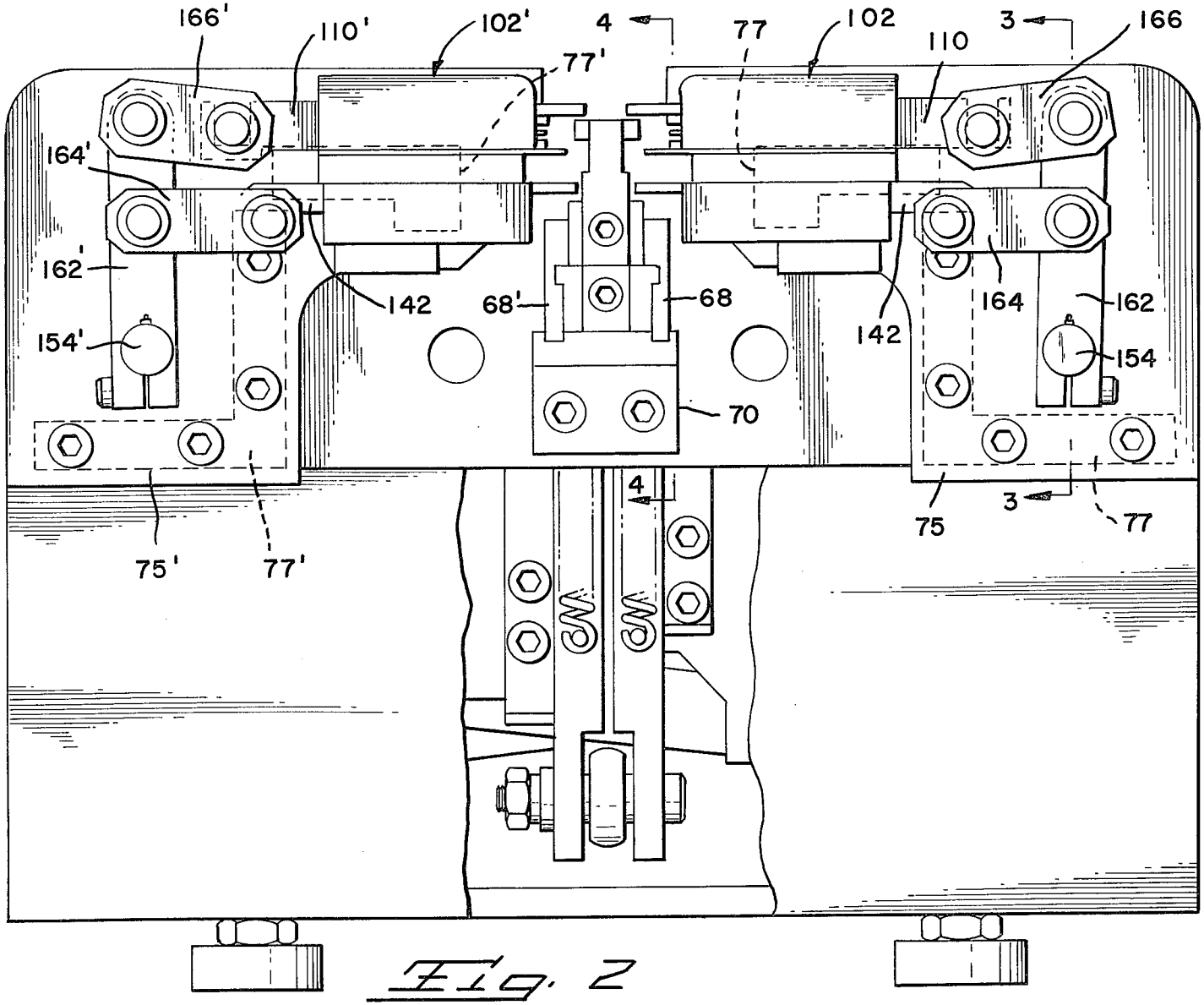
FIG. 2 is a frontal view, looking from the right in FIG. 1, of the apparatus
Figure 5:
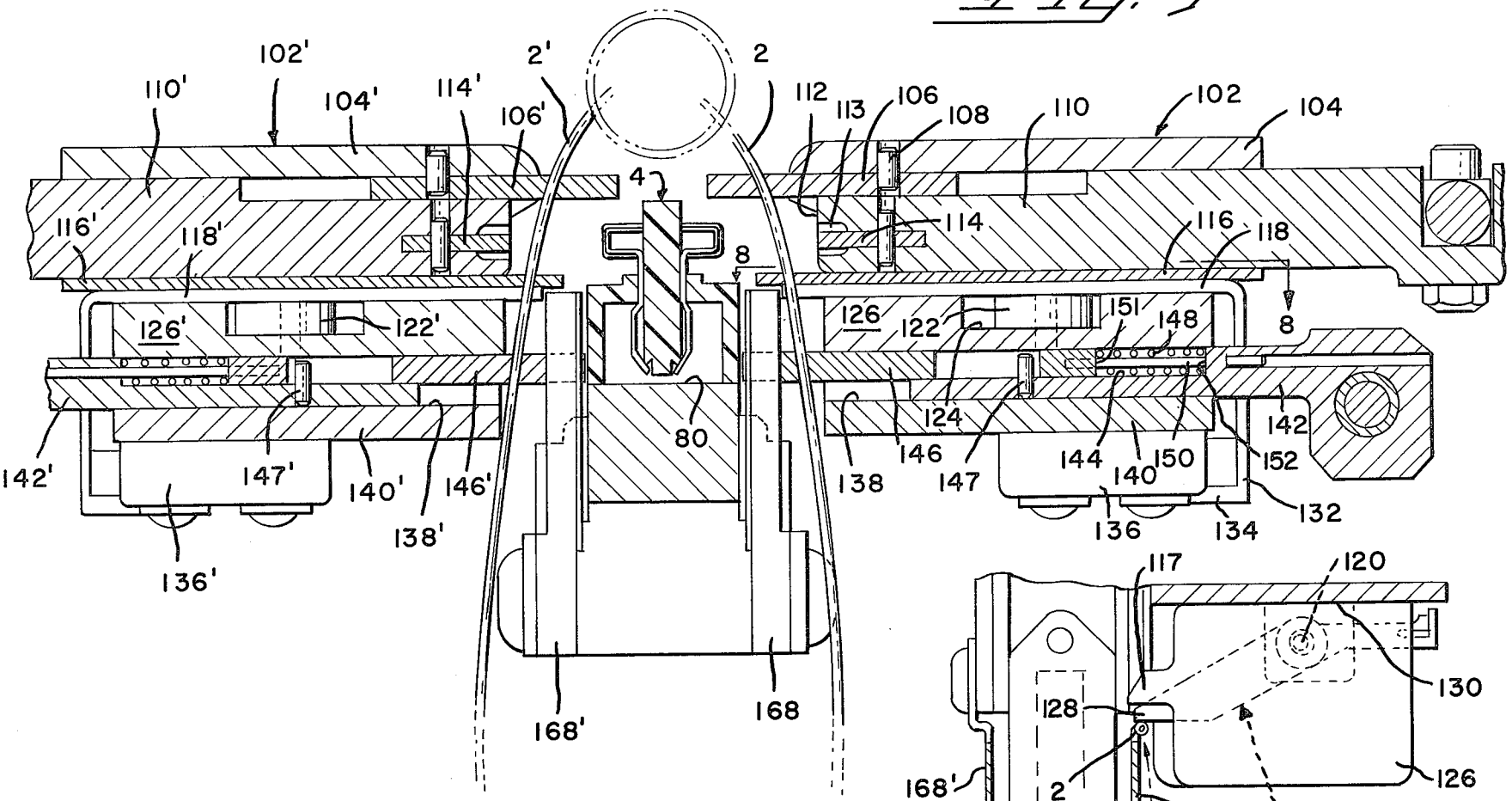
FIG. 5 is a section view taken along the lines 5—5 of FIG. 4B.

The previously identified tooling stations 102, 102' are substantially symmetrical about the center line of the apparatus as will be apparent from FIGS. 2 and 5. The tooling station 102 on the right in FIG. 2 being effective to insert wires into the right hand side of the connector while the tooling station 102' on the left inserts wires into the lefthand side thereof. Accordingly, a description of the righthand side of the apparatus as viewed in FIG. 2 will suffice for both sides and the same reference numerals, differentiated by prime marks, will be used for corresponding structural elements on the two sides of the center line of the apparatus.

The housing or support of tooling station 102 has a fixed top wall 104 to the underside of which is secured a fixed upper wire stop 106. This wire stop projects inwardly as viewed in FIG. 5 towards its center part 106' and is secured to the top wall block 104 by a suitable roll pin 108. A recess is provided on the upper surface of the insertion ram 110 to permit relative movement of the ram with respect to the stop 106 and the wire stop provides a surface against which the wire 2 is located prior to insertion into the terminal.

Figure 6:
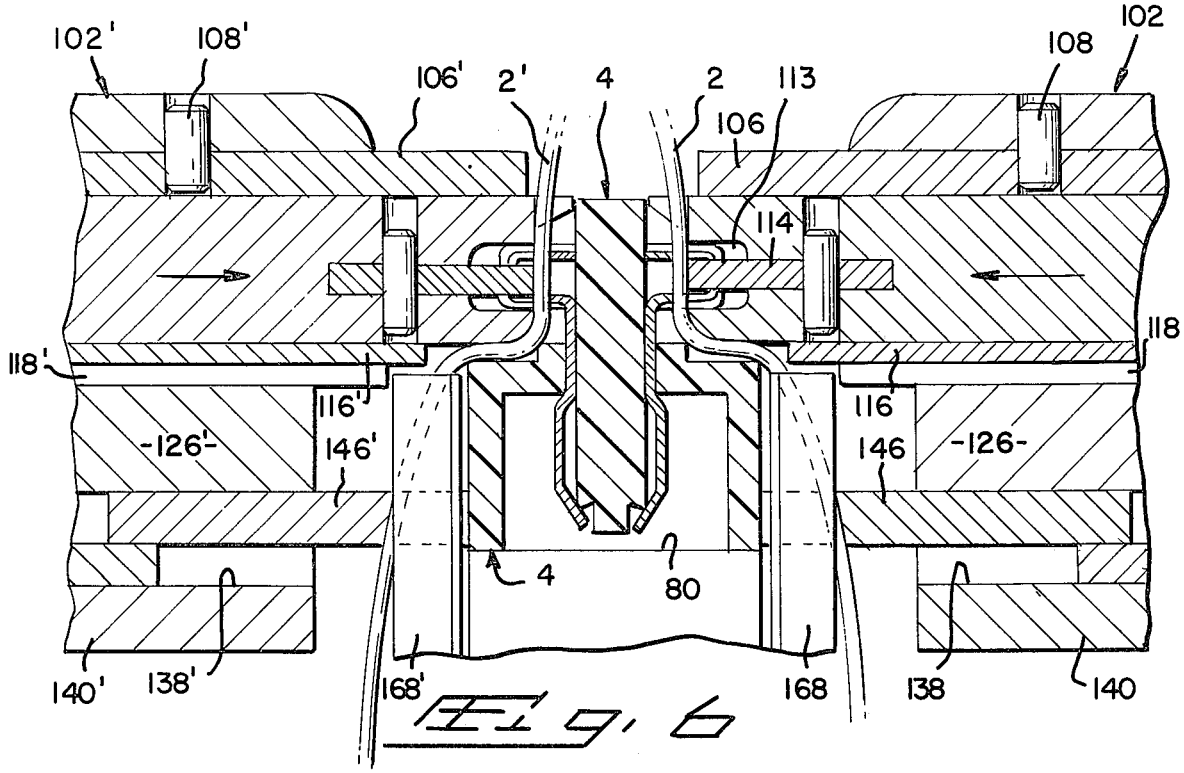
FIGS. 6 and 7 are views similar to FIG. 5 but showing the positions of the parts at different stages of the operating cycle.

The insertion ram 110 normally occupys the position shown in FIG. 5 and is movable leftwardly to the position of FIG. 6 to insert the wire 2 into the terminal, the lefthand end of the ram being dimensioned to move over a barrier wall 38 of the connector and an insertion punch 114 being mounted in a central recess 113 to push the wire 2 into the terminal as shown in FIG. 6.

Figure 8:
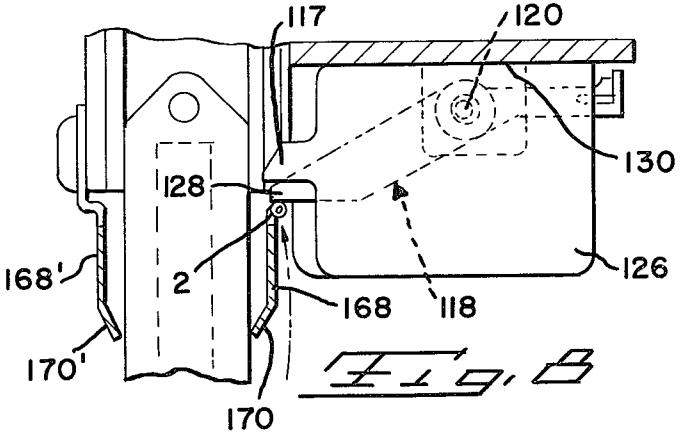
FIG. 8 is a fragmentary top plan view of one of the wire insertion stations, this view being taken along the lines 8—8 of FIG. 5.

A fixed spacer plate 116 is secured at the insertion station beneath the ram 110 and has a leftwardly projecting end 117 (FIG. 8) which provides additional guiding surface means for the wire as will be described below. Immediately beneath the plate 116, a switch actuator means 118 (FIG. 8) is mounted on a pivot pin 120 which is supported in a bearing 122, this bearing being disposed in a recess 124 in the upper surface of a fixed block 126. The switch actuator 118 has a leftwardly extending portion as viewed in FIG. 8 which is tapered at its end 128 and which extends leftwardly beyond the leftward end of the block 126 so that this end 128 can be engaged by the wire 2 to actuate the apparatus as described below. The actuator 118 extends rightwardly in FIG. 8 from the pivot pin 120 and has a downwardly extending arm 132 which is inwardly turned at its end 134. The end of this arm engages the arm of the switch 136 when the actuator is swung through a slight clockwise arc from the position of FIG. 8 to change the condition of the switch 136. When the condition of this switch 136 is changed, a single revolution clutch in the housing is engaged to drive the power shaft through a single revolution and thereby drive the inserting rams as well as the lower wire stops (described below) through the motions required for the operating cycle.

Figure 7:
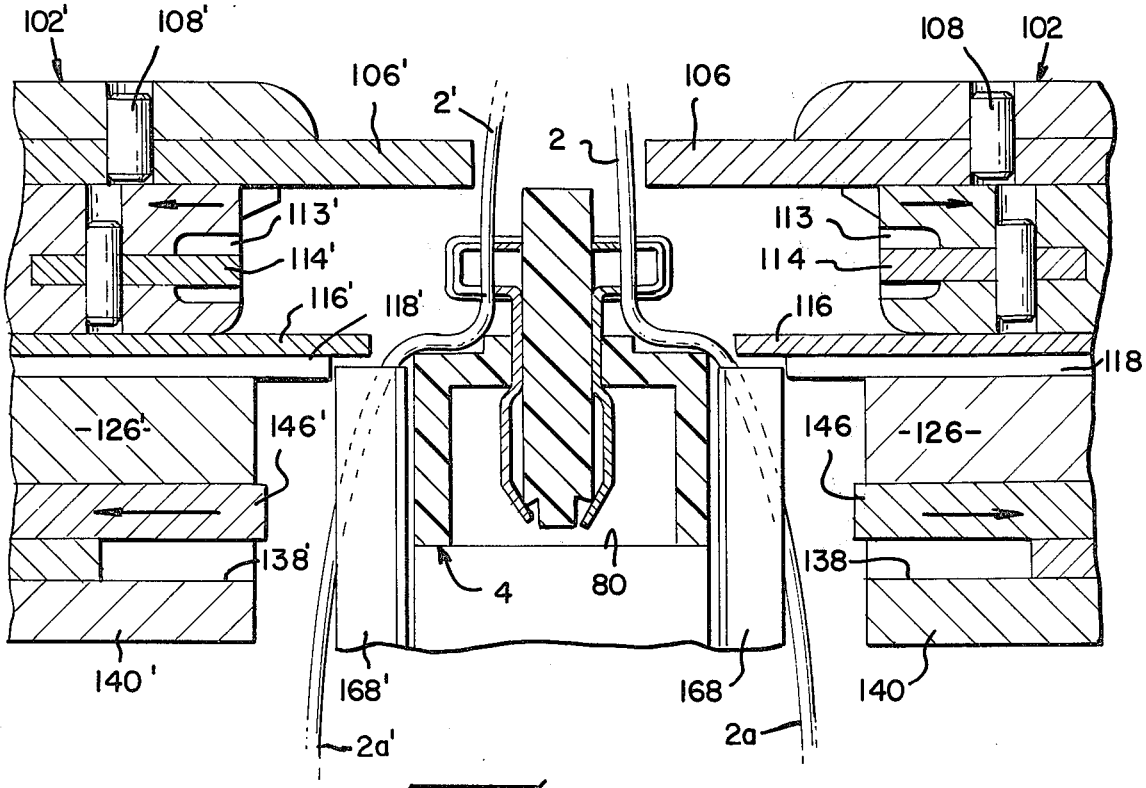

A lower wire stop 146 disposed beneath the block 126 has a lost motion pin-slot connection 147 to, a wire stop actuator rod 142 which is slidably mounted between the lower surface of block 126 and the upper surface of a fixed supported block 140. The stop 146 normally projects inwardly as shown in FIG. 5 so that its end bears against the side of a connector located on the surface 80. During the operating cycle, this stop is retracted as shown in FIG. 7 upon rightward movement of the rod 142, the stop being resiliently biased to the leftward limit of its limited movement, with respect to the carrier rod by, a biasing spring 148 which surrounds rod 150 and which is interposed between the end 151 of the wire stop and a leftwardly facing shoulder 152 of the wire stop carrier. This arrangement permits overtravel of the wire carrier rod 142 from the position of FIG. 5 while, rightward movement of the carrier 142 will be accompanied by rightward movement of the wire stop 146 by virtue of pin-slot connection 147.

The actuating means for the insertion ram 110 and the wire stop carrier rod 142 comprises an oscillatable shaft 154 which as previously mentioned, is supported in a bearing 79 in wall plate 75 and which is supported at its righthand end in a suitable bearing in a frame wall 156. A lever 158 is secured to the shaft 154 adjacent to its righthand end and the end of this lever has a pivotal connection to a link 160. This link 160 is moved vertically in both directions as viewed in FIG. 3 during each operating cycle to swing the end of the arm 158 through an arc in both directions thereby imparting limited arcuate movement in both directions to the shaft 154. As shown in FIG. 2, the shaft 154 has a lever arm 162 extending upwardly therefrom and this arm is connected by links 164, 166 to the wire stop carrier rod 142 and to the insertion ram 110 respectively. The arrangement of the parts is such that the desired motions, as described below, of the insertion ram and the carrier rod will be brought about.

The disclosed form of apparatus has static wire guides 168, 168' extending from the ends of the rails 68, 68' and these wire guides for inwardly turned ends 170, 170' so that when a pair of wires are moved inwardly from the front of the apparatus, one wire being disposed on each side of the connector support 60, the wires will be moved against the ends 128, 128' of the switch actuator 118, 118'. The wires will come to rest when they are against the fixed upper wire positioner 106, 106' the edge of the projecting part 117 of plate 116, and against the movable wire positioner 146, 146'. When the wires are against these positioning means, they will be in alignment with the insertion rams and with the wire-receiving portions of a pair of oppositely aligned terminals in the connector.

The slight movement of the actuators 118 about their pivot pins 120, 120' changes the condition of the switches 136, 136' and the previously mentioned single revolution clutch is engaged to oscillate the shaft 154. Insertion of the wires during inward movement of the insertion ram 110 takes place as shown in FIGS. 5 and 6. After insertion, the insertion rams are retracted as shown in FIG. 7 and the lower wire positioning members 146, 146' are also retracted. Thereafter, the carriage is indexed rearwardly and the inserted wires are moved towards the housing; the inserted wires can now be moved past all of the stop means described above since the movable wire positioners 146 have been retracted (FIG. 7) and the inserted wires clear the ends of the fixed wire stops and the projecting end portions of the spacer plate 116.

It is desirable to provide a static guard which is spaced from, and on each side of, the connector holding means 80 for the reason that after the wires have been inserted into all the terminals in a connector, the operator removes the connector from the connector holding means, and releases a spring catch in the machine (as described in U.S. Pat. No. 3,766,622) to cause the carriage to be driven forwardly until the supporting member is in the position of FIG. 4A. The static guard means 170 prevents injury to the operator during this stage of the operation.

An apparatus in accordance with the invention thus permits the achievement of high production rates which are achieved with power machines of the type shown in U.S. Pat. No. 3,766,622 when the intermediate portions of wires are being inserted into terminals in the connector. It will be apparent from the foregoing description that a machine in accordance with the instant invention can be modified by relative simple tooling changes to insert the end portion of the wire into the terminals. Specifically, it is only necessary to provide a shearing plate in the tooling stations rather than plate 116. A machine in accordance with the invention can thus be used from either type of wire inserting operation.

What is claimed is:

1. Apparatus for inserting intermediate portions of a plurality of pairs of wires into the wire-receiving portions of electrical contact terminals, said terminals being contained in an electrical connector and being arranged in two aligned parallel rows with said wire-receiving portions being oppositely directed whereby a pair of wires can be electrically connected to corresponding aligned terminals in said rows by locating said wires on opposite sides of said connector and moving said wires laterally of their axes, towards said connector and into the wire receiving portions of said aligned terminals, said apparatus comprising:

frame means, connector supporting means, said connector supporting means projecting cantilever fashion from said frame means for a distance which is substantially equal to twice the length of one of said rows, said connector supporting means having connector supporting surface portions for supporting said connector in an orientation with said rows extending in the projecting direction of said supporting means, first and second wire inserting rams on two opposite sides of said supporting means, said inserting rams being spaced from said frame means by a distance which is substantially equal to, or greater than, the length of one of said rows, said inserting rams being reciprocable towards and away from a connector supported on said supporting means, positioning means for providing relative movement of said supporting means and said rams with respect to each other in directions extending parallel to the projecting direction of said supporting means so that said rams can be located selectively in alignment with the wire-receiving portions of all of the aligned terminals in said rows, and wire stop means disposed proximate to said inserting rams for locating a pair of said wires on opposite sides of said supporting means and in alignment with said inserting rams whereby, upon positioning said connector on said supporting surface portions of said supporting means, repetitively actuating said positioning means to locate said rams in alignment with two predetermined aligned terminals in said rows, repetitively locating a pair of wires on opposite sides of said supporting means and against said wire stops, and repetitively reciprocating said inserting rams, said pairs of wires are inserted into the wire receiving portions of the aligned terminals in said rows.

2. Apparatus as set forth in claim 1, said wire stop means comprising wire stop members projecting towards said connector supporting means on each side of each of said inserting rams, said members being in a plane which extends normally of the projecting direction of said supporting means.

3. Apparatus as set forth in claim 2, said supporting means having clamping means thereon for clamping said plurality of pairs thereto, said clamping means being on a portion of said supporting means which is between said connector supporting surface portions and said frame means and being on the one side of said supporting means on which said supporting surface portions are located.

4. Apparatus as set forth in claim 3, each of said inserting rams having two of said wire stop members associated therewith, the first one of said wire stop members being proximate to said one side of said supporting means and the second stop member being proximate to the opposite side of said supporting means, the corresponding wire stop members associated with said first and second inserting rams being opposed to, and in alignment with each other.

5. Apparatus as set forth in claim 4, said second stop members normally projecting towards each other to an extended position, said apparatus having means for moving said second stop members to a retracted position to permit relative movement of portions of said wires therepast.

6. Apparatus as set forth in claim 5, said positioning means comprising indexing means for indexing said supporting means towards said frame means relative to said inserting rams.

7. Apparatus for inserting intermediate portions of a plurality of pairs of wires into the wire-receiving portions of electrical contact terminals, said terminals being contained in an electrical connector and being arranged in two aligned parallel rows with said wire-receiving portions being oppositely directed whereby a pair of wires can be electrically connected to corresponding aligned terminals in said rows by locating said wires on opposite sides of said connector and moving said wires laterally of their axes towards said connector and into the wire receiving portions of said aligned terminals, said apparatus comprising:

frame means, connector supporting means, said connector supporting means having an extended position in which said connector supporting means projects, cantilever fashion, from said frame means for a distance which is substantially equal to twice the length of one of said rows, said connector supporting means having connector supporting surface portions for supporting said connector in an orientation with said rows extending in the projecting direction of said supporting means, indexing means for indexing said supporting means from said extended position towards and into said frame means a distance equal to the spacing between adjacent wire-receiving portions of said rows, first and second wire inserting rams on two opposite sides of said supporting means, said inserting rams being spaced from said frame means by a distance which is substantially equal to, or greater than, the length of one of said rows, said inserting rams being reciprocable towards and away from a connector supported on said supporting means, and wire stop means disposed proximate to said inserting rams for locating a pair of said wires on opposite sides of said supporting means and in alignment with said inserting rams whereby, upon locating said supporting means in said extended position, positioning said connector on said supporting means, repetitively locating a pair of wires on opposite sides of said supporting means and against said wire stops, and actuating said inserting rams, said pairs of wires are inserted into corresponding wire receiving portions of said rows.

8. Apparatus as set forth in claim 7, said wire stop means comprising wire stop members projecting towards said connector supporting means on each side of each of said inserting rams, said members being in a plane which extends normally of the projecting direction of said supporting means.

9. Apparatus as set forth in claim 8, said supporting means having clamping means thereon for clamping said plurality of pairs thereto, said clamping means being on a portion of said supporting means which is between said connector supporting surface portions and said frame means and being on the one side of said supporting means on which said supporting surface portions are located.

10. Apparatus as set forth in claim 9, each of said inserting rams having two of said wire stop members associated therewith, the first one of said wire stop members being proximate to said one side of said supporting means and the second stop member being proximate to the opposite side of said supporting means, the corresponding wire stop members associated with said first and second inserting rams being opposed to, and in alignment with each other.

11. Apparatus as set forth in claim 10, said second stop members normally projecting towards each other to an extended position, said apparatus having means for moving said second stop members to a retracted position to permit relative movement of portions of said wires therepast.

* * * * *